United States Patent [19]

Lucian

[11] 4,418,728

[45] Dec. 6, 1983

[54] WEFT THREAD-STORAGE APPARATUS FOR A LOOM, ESPECIALLY A GRIPPER LOOM

[75] Inventor: Anton Lucian, Arbon, Switzerland

[73] Assignee: Aktiengesellschaft Adolph Saurer, Arbon, Switzerland

[21] Appl. No.: 319,807

[22] Filed: Nov. 9, 1981

[30] Foreign Application Priority Data

Dec. 17, 1980 [CH] Switzerland ..... 9297/80

[51] Int. Cl.[3] ..... D03D 47/36

[52] U.S. Cl. ..... 139/452

[58] Field of Search ..... 139/435, 452; 242/55; 66/125, 132

[56] References Cited

U.S. PATENT DOCUMENTS 3,502,253 3/1970 Van Mullelcom ..... 139/452
3,575,217 4/1971 Pfarrwaller ..... 139/452
3,825,198 7/1974 Oehninger ..... 139/452

FOREIGN PATENT DOCUMENTS 3030626 4/1981 Fed. Rep. of Germany ..... 139/452

*Primary Examiner*—Henry Jaudon
*Attorney, Agent, or Firm*—Werner W. Kleeman

[57] ABSTRACT

A weft thread-storage apparatus for a loom, especially a gripper loom, comprises a storage for the temporary loop-shaped storage of a filling or weft thread to be inserted into the weaving shed. The substantially box-shaped storage is provided at its one end face or side with an opening of substantially slot-shaped configuration. This opening extends over practically the entire width of the storage. Internally of the storage, in the neighborhood of the slot-shaped opening, there is arranged at least one loop divider in the form of a motor-driven roll. The rotational axis of such roll extends perpendicular to the floor or base surface of the storage and its direction of rotation corresponds to the infeed direction of the weft thread. By regulating the peripheral speed at the roll it is possible to store loops of different length.

8 Claims, 3 Drawing Figures

WEFT THREAD-STORAGE APPARATUS FOR A LOOM, ESPECIALLY A GRIPPER LOOM

CROSS REFERENCE TO RELATED APPLICATION

This application is related to my commonly assigned, copending U.S. application Ser. No. 06/181,666, filed Aug. 26, 1980, now abandoned.

BACKGROUND OF THE INVENTION

The present invention relates to a new and improved construction of a weft thread-storage apparatus for a loom, especially a gripper loom.

Generally speaking, the invention relates to a weft thread-storage apparatus for a loom, especially a gripper loom, comprising a storage which can be connected with a suction air source. At the one end face or side of the storage there extends practically over the entire width thereof an opening of substantially slot-shaped configuration. The storage serves for the temporary, loop-shaped storing of a weft or filling thread which is to be inserted into the weaving shed, and comprises a central loop divider for laying mutually parallely extending partial thread loops.

With looms, especially gripper looms when confronted with increasing weaving widths there exists the problem of preparing at a given depth of the storage a sufficient thread length for the weft or filling which is to be inserted. Such problems are aggravated by the tendency of increasing the weft insertion frequency, and therefore, the need for higher storage operating cycles or frequencies.

While there are already known constructions of storage apparatuses which are capable of storing sufficient thread lengths, such constructions require an enormous amount of space and/or complicated mechanisms with relatively high moments of inertia. Thus, these state-of-the-art storage apparatuses are unsuitable for solving the aforementioned problems.

There is known, for instance, from French Pat. No. 2,153,185 and Swiss Pat. No. 441,151 a storage which is divided into several separate channels by means of loop dividers. According to the aforementioned Swiss Pat. No. 441,151, for instance, there is successively threaded or looped into these separate channels a portion of the weft thread by alternatingly opening and closing valves which are arranged at the air suction openings.

It will be readily appreciated that with these prior art proposals there is required a relatively high constructional and circuit expenditure, especially with respect to the valve means.

In German Pat. No. 2,164,891 there furthermore is disclosed an apparatus for preparing predetermined thread lengths at a jet-weaving machine. Here, the storage equally is divided into separate chambers or compartments by wall means. The thread infeed to each chamber or compartment is performed by adjusting or positioning a thread infeed tube for looping the thread into the chamber, while simultaneously actuating or switching air suction valves and the thread clamps at the individual transfer locations. With this prior art design air suction valves are equally required for each chamber or compartment.

This arrangement is equally complicated and expensive and incapable of satisfying present day requirements.

SUMMARY OF THE INVENTION

Therefore, with the foregoing in mind it is a primary object of the present invention to provide a new and improved construction of weft thread-storage apparatus for a loom, especially a gripper loom which is not associated with the aforementioned drawbacks and limitations of the prior art constructions.

Another and more specific object of the present invention aims at providing a new and improved construction of weft thread-storage apparatus of the previously mentioned type, which is characterized by high efficiency while being exceedingly simple in construction and design and having minimal storage depth.

Now in order to implement these and still further objects of the invention, which will become more readily apparent as the description proceeds, the weft thread-storage apparatus of the present development is manifested by the features that the loop divider, which is arranged internally of the storage in the neighborhood of the slot-shaped opening, is constituted by a motor-driven roll. The rotational axis of such roll extends substantially perpendicular to the floor or base surface of the storage and its direction of rotation corresponds to the infeed direction of the thread.

It is advantageous to arrange the motor-driven roll in alignment with the lengthwise axis of symmetry of the internal space of the storage.

Furthermore, it is advantageous if the rotational speed or the peripheral speed of the roll, as the case may be, is regulatable as a function of the thread withdrawal speed or the thread storage speed, respectively.

Thus, it is selectively possible to either adjust the peripheral speed of the roll such that it amounts to half the thread withdrawal speed for forming equal partial loops, or to adjust it such that it is less than half the thread withdrawal speed for forming unequal partial loops.

By virtue of a peripheral speed of the roll which is less than half the thread withdrawal speed it is possible to reduce the acceleration forces at the stored thread occurring during the weft insertion. This is achieved in that the partial loop of the thread at the thread outlet side is made shorter than the partial loop at the thread inlet side, whereby there can be shortened the thread portion of the partial loop of the thread which is to be accelerated.

Furthermore, the arrangement can be constructed such that the slot-shaped opening of the storage partially forms the outlet opening and partially the inlet opening for the thread, between which there is arranged the roll. Moreover, the thread outlet side may be internally limited, in the direction of extent of the slot, by means of a guide bolt. Furthermore, the storage is provided at its inlet side with a substantially arcuate-shaped infeed surface for the thread.

BRIEF DESCRIPTION OF THE DRAWINGS

The invention will be better understood and objects other than those set forth above will become apparent when consideration is given to the following detailed description thereof. Such description makes reference to the annexed drawings which depict an exemplary embodiment of a weft thread-storage apparatus according to the invention and wherein.

DETAILED DESCRIPTION OF THE PREFERRED EMBODIMENTS

Figures 1, 2, 3:
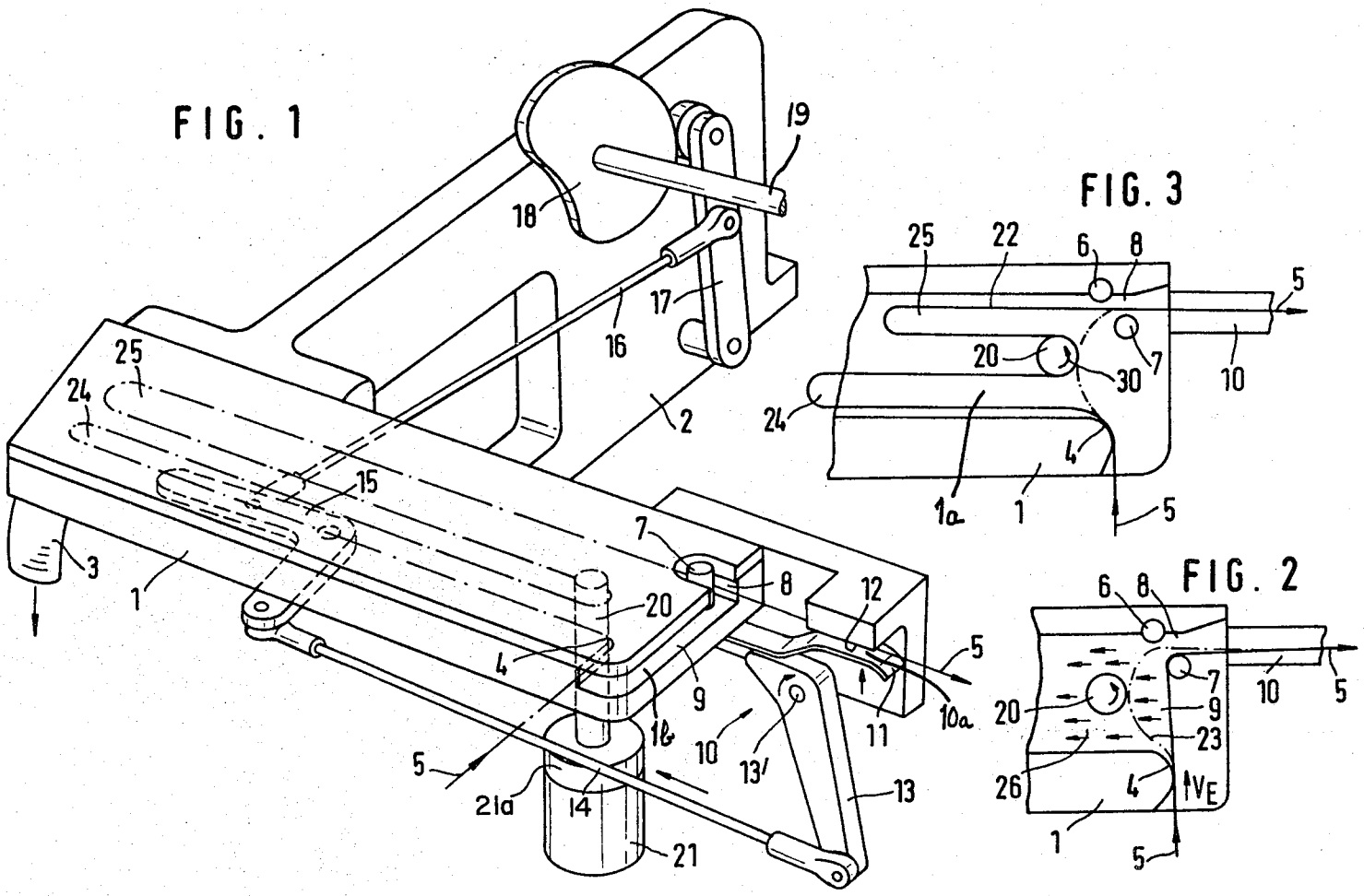
FIG. 1 is a perspective view of the weft thread-storage apparatus for a loom according to the invention.
FIGS. 2 and 3 are graphic illustrations of two phases of the temporary storing of a thread within the storage magazine or storage.

Describing now the drawings, the weft thread-storage apparatus illustrated by way of example and not limitation in FIG. 1, will be seen to comprise a storage or storage magazine 1 which is fixedly arranged at a protruding portion or extension 2 of a here not further illustrated loom, especially a gripper loom.

Storage 1 is constructed such as to possess a substantially box-shaped configuration and at its closed end, which is its left end with respect to the drawing of FIG. 1, is connected in flow communication with a suction line or conduit 3. At its front end or side the box-shaped storage or storage magazine 1 is provided with a slot or substantially slot-like opening 9 which extends over practically the entire width of the storage 1. Such slot or slot-like opening 9 is provided at its thread inlet side with a substantially arcuate-shaped infeed or run-in surface 4 for the weft or filling thread 5.

This arcuate-shaped infeed surface 4 enables a gentle or soft infeed of the filling or weft thread 5, when such is sucked into the storage 1 under the action of the negative pressure coming from suction line 3 or the action of the air flow present in storage 1. This arcuate-shaped infeed surface 4 equally allows for a faultless sucking-in of highly twisted as well as extremely fine, very smooth yarns or the like.

The thread 5 extends with its starting thread portion, viewed in the direction of weft thread insertion, through an outlet opening 8 bounded or limited, in this case, by two bolts or pins 6 and 7 (FIGS. 2 and 3) to a subsequently arranged thread brake 10 which will be more fully described hereinafter. The thread outlet opening 8 is in alignment with a clamping region 10*a* of the thread brake 10. The thread outlet opening 8 is arranged at the front end or side of the storage 1, and specifically, at the end of the slot or slot-like opening 9 which is located opposite to the thread infeed location.

The bolts or pins 6 and 7 initially have imparted thereto a guide function with respect to the thread 5, as best seen by referring to FIG. 3. Additionally, the one bolt or pin member 7 is arranged such that the thread end, following the removal of the weft thread reserve out of the storage 1 according to FIG. 2, extends transversely over the entire slot 9 of the storage machine 1, and thus, while being withdrawn from a not further illustrated bobbin or spool again can be faultlessly looped into the storage magazine 1, as will be described hereinafter in greater detail.

The aforementioned thread brake 10, in the embodiment under discussion, encompasses a movable spring-elastic clamping blade or leaf member 11 which is fixed at one end. This clamping blade 11 coacts with a stationary counter-clamping surface or member 12. Clamping blade 11 can be acted upon by an actuation lever 13 for the purpose of performing its thread clamping function. The actuation lever 13 is pivotable about a pin or shaft 13′ and is operatively connected by means of a control lever system with a cam-shaped control disc or cam element 18. The control lever system contains the guide rods or links 14, 15, 16 and 17 or equivalent structure. The control cam or disc 18 is seated upon a shaft 19 which, in not here further illustrated but known manner, revolves in synchronism with the loom shaft, so that the actuation of the thread brake 10 can be accomplished in cycle with the weft thread insertion. The arrangement is undertaken such that the clamping blade 11 is spaced from the counterclamping surface 12 or can be pressed against such counterclamping surface 12 with different pressures or forces. This enables, during the different phases during the course of the weft thread insertion, to act in a regulating fashion upon the markedly alternating tension conditions prevailing at the thread, in that the thread emanating out of the storage 1 is exposed in corresponding manner to different braking forces.

As further illustrated in FIGS. 1, 2 and 3, the box-shaped storage or storage magazine 1 has a predetermined width which enables forming, by means of the weft thread 5, more than one thread loop in the storage 1. The formed thread loops are placed such that they lie next to each other without contact.

For this purpose there is arranged in close proximity to slot or slot-like opening 9 within the internal space or chamber 1*a* of the storage 1, preferably in alignment with the lengthwise symmetrical axis thereof, a loop divider, here shown in the form of a revolving or rotating roll 20. According to FIG. 1, the rotational axis of this roll 20 extends substantially vertically or perpendicular to the floor or base surface 1*b* of storage 1. The roll 20 is driven by a suitable drive motor 21. The direction of rotation of motor-driven roll 20 corresponds to the infeed direction of the thread 5 into the storage 1, as generally indicated by the arrow 30 in FIG. 3.

In a here not further particularly illustrated but known manner the outer surface of motor-driven roll 20 can be provided with a suitable covering or coating, which exerts at the thread 5 a sufficient but gentle and protective frictional action which serves for the thread transport over the roll 20.

Furthermore, the drive motor 21 can be coupled with any suitable control means, such as control gearing, generally indicated in FIG. 1 by reference numeral 21*a*, or equivalent structure which serves for the regulation of the rotational or peripheral speed of the motor-driven roll 20 according to the encountered alternating operating conditions, such as during a yarn change or during changes in the weft insertion frequency, as well as for the determination of the mutual length of the thread loops, as will be more fully described hereinafter.

Moreover, it is conceivable to provide more than two partial loops in the storage 1, which correspondingly would require an arrangement of additional rolls, like the roll 20, serving as loop dividers.

As previously mentioned, following the weft insertion or the insertion of the thread 5 into the storage apparatus, the thread 5 lies in a stretched condition between the infeed surface 4 and the outlet opening 8, and thus, extends transversely over the entire slot or slot-like opening 9, as has been illustrated in FIG. 2.

Under the action of a suction air current, which has been indicated by the arrows 26, the thread 5 is drawn into the internal space 1*b* of the storage 1 at a withdrawal speed $V_E$ and initially reaches the position 23, shown in FIG. 2, where the thread 5 comes to rest against the roll 20.

Owing to the rotation of the motor-driven roll 20 at a suitable rotational speed there are formed under the action of the suction air current 26 two essentially equal partial thread loops 24 and 25, as can best be seen by referring to FIG. 1.

It will be seen that the partial thread loops 24 and 25 are practically of equal length if the peripheral speed $R_U$ of the roll 20 is equal to $R_U=(V_E/2)$, wherein the volume of the storage 1 can be exploited to an optimum degree.

On the other hand, it is now also possible to reduce the high acceleration forces acting upon the stored thread during the weft insertion by accomplishing the previously mentioned change in the rotational speed of the motor-driven roll 20, and especially the acceleration forces caused by a gripper which is already in motion at the time of the thread transfer. For this purpose, the partial loop 25 is made shorter at the thread outlet side than the partial loop 24 at the thread inlet side, as has been clearly illustrated in FIG. 3. Thus, the thread portion 22, which is to be accelerated, of the thread partial loop 25 is made shorter. For accomplishing this process, the peripheral speed $R_U$ of the roll 20 has to be adjusted so that it is less than half the previously described thread withdrawal speed $V_E$.

Due to the aforementioned measures it is not only possible, while requiring a minimal amount of constructional expenditure, to store a considerable amount of thread reserve in the storage 1, but it is also possible to act in a regulating fashion upon the mutual lengths of the partial loops, and thus, upon the length of the thread portion which is to be accelerated when transferring the thread to the thread insertion device.

While there are shown and described preferred embodiments of the present invention, it is to be distinctly understood that the invention is not limited thereto but may be embodied and practiced within the scope of the following claims. Accordingly,

What I claim is:

1. A weft thread-storage apparatus for a loom, especially a gripper loom, comprising:

a storage for the temporary storage of a weft thread which is to be inserted into a weaving shed;

means defining a source of suction air with which there can be connected said storage;

said storage having an end region which is open practically over its entire width and possesses a substantially slot-shaped configuration defining a slotted opening;

a substantially central loop divider for laying adjacently situated and mutually parallely extending partial thread loops;

said loop divider being arranged in an internal space of said storage at the neighborhood of said slotted opening;

said loop divider comprising a motor-driven roll having a rotational axis;

the rotational axis of said roll extending substantially perpendicular to a base surface of said storage; and the direction of rotation of said roll corresponding to an infeed direction of the thread into said storage.

2. The weft thread-storage apparatus as defined in claim 1, wherein:

said motor-driven roll is arranged substantially in alignment with a lengthwise symmetrical axis of the internal space of said storage.

3. The weft thread-storage apparatus as defined in claim 1 or 2, further including:

a drive motor for driving said motor-driven roll;

control means arranged between said drive motor and said motor-driven roll for regulating the peripheral speed of said motor-driven roll as a function of the thread withdrawal speed from or the thread infeed speed of the storage.

4. The weft thread-storage apparatus as defined in claim 3, wherein:

said control means comprises control gearing for driving said motor-driven roll at a peripheral speed which, for forming substantially equal partial loops, amounts to essentially half the thread-withdrawal speed.

5. The weft thread-storage apparatus as defined in claim 3, wherein:

said control means comprises control gearing for driving said motor-driven roll at a rotational speed which, for forming unequal partial loops, amounts to less than half the thread withdrawal speed.

6. The weft thread-storage apparatus as defined in claim 1, wherein:

said slot-shaped end region of said storage partially forming an outlet opening and partially an inlet opening for the thread; and said roll being arranged between said outlet opening and said inlet opening for the thread.

7. The weft thread-storage apparatus as defined in claim 6, further including:

at least one guide bolt for internally delimiting the outlet opening in the direction of extent of said slot-shaped end region.

8. The weft thread-storage apparatus as defined in claim 6, wherein:

said storage is provided at the region of said inlet opening with a substantially arcuate-shaped infeed surface for the thread.

* * * * *